United States Patent [19]

Tuell

[11] 3,996,820

[45] Dec. 14, 1976

[54] SELF-ADJUSTING PIPE WRENCH

[76] Inventor: James Larry Tuell, 1240 10th St., Manhattan Beach, Calif. 90266

[22] Filed: Oct. 14, 1975

[21] Appl. No.: 621,651

[52] U.S. Cl. ..... 81/145
[51] Int. Cl.[2] ..... B25B 13/20
[58] Field of Search ..... 81/130 R, 142, 145, 81/148

[56] References Cited

UNITED STATES PATENTS

| | | | |
|---|---|---|---|
| 1,082,112 | 12/1913 | Cutler | 81/142 X |
| 2,050,102 | 8/1936 | Kujala et al. | 81/145 X |
| 2,760,396 | 8/1956 | Simpson | 81/145 |
| 2,878,702 | 3/1959 | Anderson | 81/145 |
| 2,914,980 | 12/1959 | Flaig | 81/145 |
| 3,817,128 | 6/1974 | Evans | 81/145 |

*Primary Examiner*—Al Lawrence Smith
*Assistant Examiner*—James G. Smith

[57] ABSTRACT

A self-adjusting pipe wrench which automatically positions itself about a desired article is disclosed. The term "self-adjusting" means that the pipe wrench can be automatically moved from an open position to a closed position when a specific member is actuated. The wrench comprises a wrench handle and a slidably mounted jaw member coupled to the wrench handle such that the jaw member may be selectively moved into a plurality of positions. A locking member is coupled to the handle and selectively engages the jaw member such that the locking member secures the jaw member in a predetermined position. An automatic return mechanism is coupled to the jaw member and to the wrench handle, whereby the jaw member is slidably moved into substantially closed position about a desired article when the locking member is disengaged from the jaw member. By use of the self-adjusting pipe wrench of the present invention, articles of varying sizes and shapes may be easily secured by the jaw member of the wrench in a simple, yet secure fashion.

9 Claims, 4 Drawing Figures

SELF-ADJUSTING PIPE WRENCH

BACKGROUND OF THE INVENTION

1. Field of the Invention

This invention relates to the field of adjustable pipe wrenches and, more particularly, to self-adjusting pipe wrenches.

2. Prior Art

Pipe wrenches are well-knwon in the art. A typical prior art wrench has a rotatable screw member which causes the jaw to be selectively moved upward or downward by rotation of such member. When it is desired to use such a wrench, the wrench is opened until the user believes that the jaws will fit about the desired object. The jaws are then placed about the object and fine adjustment is made with the rotatable member such that the jaws of the wrench securely positions the article therein. While these types of wrenches are effective with respect to positioning an article between the jaws, it is necessary to rotate the adjusting member until the exact positioning of the jaws is achieved. This is time consuming and presents a problem, especially in a area which is constrained as to space.

The prior art also teaches adjustable pipe wrenches without the conventional screw member mechanism. For example, Bonner, U.S. Pat. No. 737,199, discloses a sliding adjustable wrench in which the movable jaw is provided with teeth which engage corresponding teeth on the wrench handle and is urged into engagement by a spring.

Another prior art wrench is disclosed by Werner, U.S. Pat. No. 1,784,123. Werner teaches disengagement of the adjustable wrench by pressure on a yoke which disengages teeth located on both the handle and the movable jaw member.

Yet a further prior art wrench is disclosed by Bartenstein, U.S. Pat. No. 1,168,844. Bartenstein discloses an adjustable wrench in which pressure on the movable jaws causes disengagement of one section of the wrench with respect to another.

While these prior art disclosures provide simple means of adjustment of a pipe wrench by way of a rotatable screw member the present invention employs a uniquely designed locking member and automatic, self-adjusting return mechanism which are interrelated, whereby when the locking member is disposed from a first position into a second position, the slidably mounted jaw member is urged forceably down to close about the desired article. This movement is not accomplished by rotation or other movement of any other member as required by the prior art, but is provided for in an automatic manner by a uniquely designed return mechanism which couples a moveable jaw to the wrench handle. Thus, while the prior art wrenches do provide for adjustable jaw members, such adjustment is not by means of a self-adjusting automatic return mechanism and an associated locking member.

BRIEF SUMMARY OF THE INVENTION

The present invention relates to self-adjusting wrenches, and more specifically, to self-adjusting pipe wrenches which do not require any rotatable elements or other similar elements in order to adjust the jaws about a desired article. The pipe wrench of the instant invention comprises a wrench handle having a top first section and a bottom second section. The first section has a tooth portion extending upward therefrom and means for selectively positioning and slidably retaining a jaw member therein. The bottom section is of a typical elongated handle configuration. The jaw member used in the instant invention has a tooth-containing member coupled to an elongated leg member. The tooth-containing member is arranged and configured whereby the desired article is positioned between the tooth-containing member on the jaw and the tooth-containing member positioned on the first section of the wrench handle. The leg member is slidably mounted in the first section of the handle such that the jaw may be moved into a plurality of predetermined positions. The leg member also has engaging means disposed along the length thereof for selectively retaining the jaw in a predetermined position. A locking member is yieldably disposed in the first section, which member has engaging means for selectively engaging and interlocking with the engaging means on the leg member. The locking member is movable from a first position to a second position. When in the first position, the engaging means on the locking member engages and interlocks with the engaging means on the leg member so as to render the jaw substantially immovable. When in this position, the distance between the horizontal tooth-containing member of the jaw and the tooth section atop the wrench handle is fixed. When the locking member is in the second position, the jaw is rendered slidable in the top section and can thus assume a plurality of positions.

A self-adjusting, automatic return mechanism is coupled to the first section of the wrench handle and to the jaw. The self-adjusting return mechanism represents a point of novelty and a distinct improvement over the prior art. The return mechanism encourages the jaw to slidably move into a closed position without the need to continuously rotate or otherwise move any member. When the locking member is in the first position, the self-adjusting return mechanism exerts a downward force on jaw. This helps hold the jaw member in this configuration because such force retards accidental movement of the locking member. When the locking member is moved into the second position, the self-adjusting return mechanism urges the jaw member to proceed downward toward the wrench handle until the tooth members on the jaw engage such article.

It is, therefore, an object of the present invention to provide a pipe wrench with a slidable jaw which may be automatically self-adjusted to the proper predetermined position to secure a pipe or other workpiece inserted between the jaw and the top of the wrench handle.

Another object of the present invention is to provide a self-adjusting pipe wrench which is easy to use, strong, yet inexpensive to manufacture and simple to construct.

Yet a further object of the present invention is to provide a self-adjusting pipe wrench which can position itself about a workpiece located in a confined area.

The novel features of the present invention, which are believed to be characteristic of the invention, both as to its organization and method of operation, together with further objectives and advantages thereof, will be better understood from the following description considered in connection with the accompanying drawings in which a presently preferred embodiment of the invention is illustrated by way of example. It is to be expressly understood, however, that the drawings are for the purpose of illustration and description only and are not intended as a definition of the limits of the invention.

DETAILED DESCRIPTION OF THE INVENTION

Figure 1:
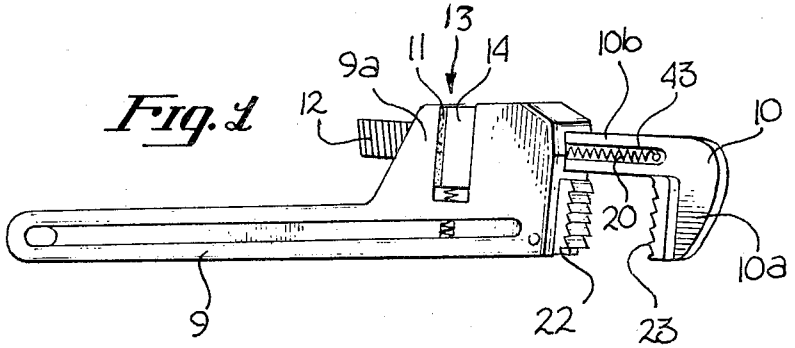
FIG. 1 is a perspective view showing the self-adjusting pipe wrench of the present invention.

A presently preferred embodiment of the automatic self-adjusting pipe wrench is shown in FIG. 1. In its most basic form, the wrench comprises a handle 9, of a typical configuration, a slidably motivated jaw member 10 coupled to the handle 9, a locking member 13 selectively engaging the jaw 10, and a self-adjusting, automatic return mechanism 20. Return mechanism 20 is coupled to and moves jaw member 10 in the direction toward tooth member 22 when the locking member 13 is moved from a first position to a second position. The specific action of locking member 13 and return mechanism 20 will be discussed in greater detail herein.

Figure 2:
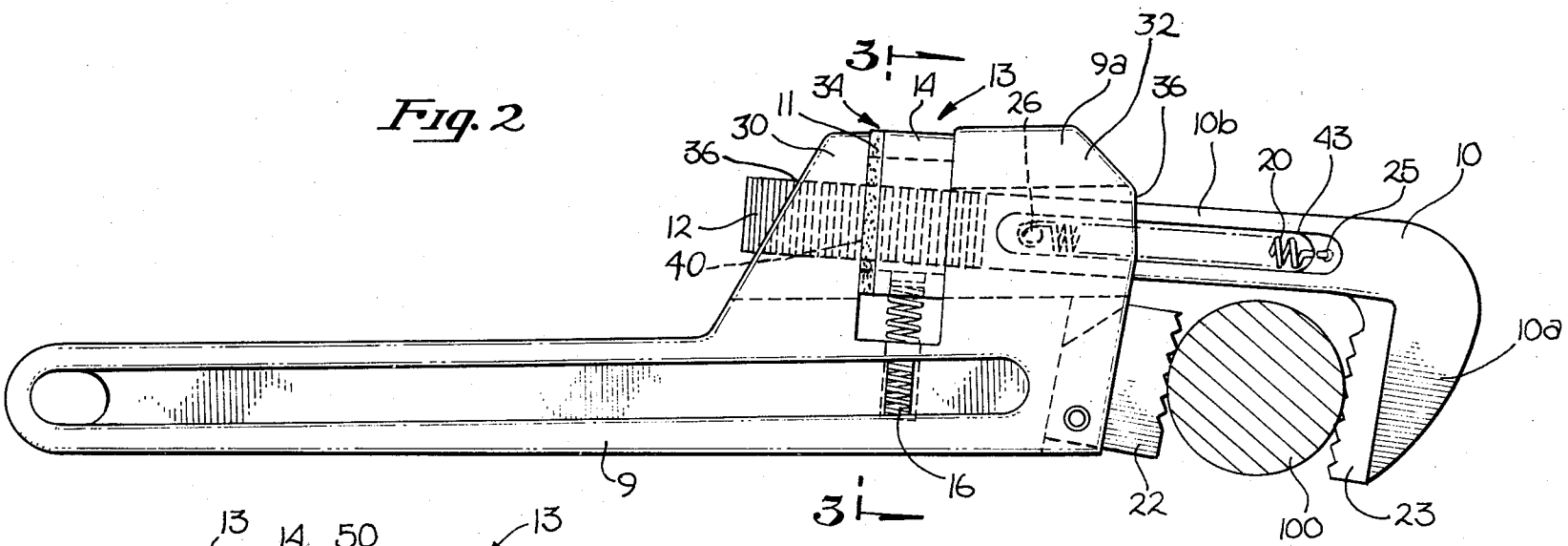
FIG. 2 is a plan view showing the pipe wrench of the instant invention with the jaw member secured about a workpiece.

Referring now to FIG. 2, one can see that the jaw member 10 is positioned in the first section 9*a* of the handle 9. The jaw member 10 has a generally L-shaped configuration comprised of cantilevered member 10*a* and a leg member 10*b*. Disposed on member 10*a* are tooth-like projection forming tooth member 23. Handle 9 is of a typical configuration, but has a uniquely designed first section 9*a*. Section 9*a* extends outward from the wrench handle 9 adjacent the top thereof, and is comprised, in the presently preferred embodiment, of two subsections 30 and 32. Both 30 and 32 have a hole or opening 36 disposed therethrough arranged and configured to selectively and slidably retain the leg 10*b* of jaw member 10 therein. Disposed between subsections 30 and 32 is a slot 34. Slot 34 is arranged and configured to position the associated locking member 13 therein. Handle 9 also has typical tooth-like projections forming tooth member 22 disposed adjacent the top thereof. Tooth member 22 is arranged and configured to grip a workpiece 100 so as to prevent the piece 100 from rotational movement.

Figure 3:
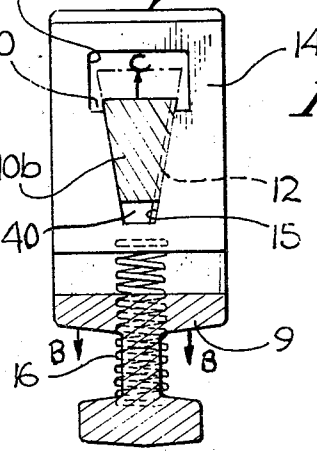
FIG. 3 is a cross-sectional view of FIG. 2 taken through section line 3—3 showing the locking member.

Locking member 13, most clearly shown in FIGS. 2 and 3, is comprised of three sections: the first section, referred to as wedge block 14, has a generally rectangular configuration and is preferably made of steel or other hard metal; the second section is a rubber pad 11 disposed beneath the wedge block 14, so as to be sandwiched between block 14 and section 30. Pad 11 enables the locking member 13 to be moved within slot 34; the third section is an associated spring 16 coupled to one end of the wedge block 14 so as to be positioned between wedge block 14 and the wrench handle 9. Upon depression of wedge block 14 inward, spring 16 is caused to compress. When wedge block 14 is released, spring 16 caused wedge block 14 to return to its original position.

Figure 4:
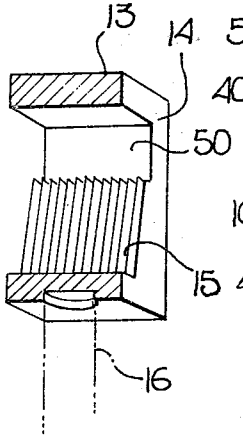
FIG. 4 is a cut-away view of the locking member shown in FIG. 3

Wedge block 14 and rubber pad 11 have an opening 40 in the shape of a wedge disposed therethrough in the presently preferred embodiment so as to be in alignment with opening 36 in subsections 30 and 32. Opening 40 is arranged and configured such that the wedge-shaped leg member 10*b* of the jaw 10, is able to be selectively retained therein. Disposed on the inside surface of the locking member 13, and more specifically, the inside surface of wedge block 14, are means for engaging the leg 10*b* of the jaw 10. This is more clearly shown in FIG. 4. In the presently preferred embodiment, the engaging means take the shape of serrated surfaces or engaging serrations 15 disposed on one side of the wedge 14. It is to be understood, however, that the other configuration of opening 40 and means for retaining leg 10*b* therein are within the scope of this invention. Engagement of leg 10*b* by locking member 13 is achieved by serrations 12 or other means disposed along the length of leg 10*b*, which interlock with serrations 15 on wedge block 14.

Referring again to FIGS. 1 and 2, one can see that leg 10*b* of the jaw 10 has a slot 43 or other opening disposed along the length thereof. Within slot 43 is the self-adjusting return mechanism 20. In the presently preferred embodiment, the return mechanism 20 is a spring coupled by a pin member 25, to the jaw 10 adjacent the top thereof, and to the top section 9*a* via pin member 26 of the wrench handle 9. Of course, it is understood, that other self-adjusting return mechanisms are also within the scope of this invention so long as their effect on the jaw member 10 and handle 9 are as discussed herein.

The instant self-adjusting pipe wrench operates as follows. Assuming that the jaw 10 is in a substantially closed position with tooth member 22 adjacent to tooth member 23, it now becomes necessary to separate such tooth members, such that a workpiece 100 may be inserted thereinbetween. To accomplish this, the user grasps the handle 9 and pushes or slides locking member 13 inward toward the handle 9. When locking member 13 is fully extended from the handle 9, it is referred to as being in the first position, and when member 13 is depressed inward, it is referred to as being in the second position. Because rubber pad 11 is sandwiched between wedge block 14 and section 30, such sliding action is encouraged. As the locking member 13 is disposed toward the handle 9, spring 16 is compressed.

Referring to FIGS. 2 and 3, one can see that should the locking member 13 move into the compressed or second position, the serrated surfaces 15 disposed along the wedge block 14 would disengage from the serrations 12 on the leg 10*b* and cause the leg 10*b* to move into a substantially larger opening 50. This is indicated in FIG. 3 by arrows B—B indicating the direction of movement of the locking member 13, and by phantom lines and arrow C, indicating the repositioning of leg member 10*b*. Inasmuch as the leg 10*b* proceeds out of its containment within the opening 40 in the locking member 13, engaging serrations 12 and 15 would disengage and leg 10*b* would be free to move. However, because spring member 20, a typical extension spring, is coupled, by a pin member 25, to the jaw member 10 adjacent the top thereof, and by a pin member 26, to subsection 32, member 10*a* of the jaw 10 remains disposed in the closed position, i.e. with members 22 and 23 adjacent to each other. However, if there is a separation between members 22 and 23, depressing locking member 13 would cause jaw 10 to move toward the closed position.

With the locking member 13, depressed, one can extend the leg 10*b* of the jaw 10 in the upward direction inasmuch as the serrated surfaces 12 of leg 10*b* are freed from their mating engagement with serrated surfaces 15 on the locking member 13. When the jaw is extended out a sufficient distance such that the user is certain that the tooth members 22 and 23 will fit about the workpiece 100, the locking member 13 may be released, thus fixably positioning the jaw 10 in the open position. Spring 16 causing locking member 13 to move outward from handle 9. The jaw 10 remains in this fixed open position inasmuch as serrations 12 have once again engaged serrations 15 and the leg 10*b* is as indicated in FIG. 3. The workpiece 100 is then inserted between the tooth members 22 and 23, and the locking member 13 is again depressed. Depressing the locking member 13 a second time causes the spring 20 to once again automatically urge the jaw member 10 into a closed position. However, inasmuch as the workpiece 100 is disposed between the jaw 10 and the wrench handle 9, the jaw 10 proceeds down until it matingly engages with such workpiece. The locking member 13 is then again released, thus locking the jaw 10 into position with the workpiece 100 disposed in between tooth members 22 and 23 with the locking action of leg 10*b* and locking member 13 as explained hereinabove.

Because of the automatic adjustability of the jaw, the wrench of the instant invention may easily be used to grasp objects even when such objects are in a tightly confined area. There is no rotatable member which has a screw-like action on the leg 10*b* of the jaw 10, and thus there is no need for the user to rotate a screw member until the jaw is extended and then rotate the member in the opposite direction until the jaw is closed about the workpiece. Moreover, the wrench can be selectively held open until the defined object is positioned therein. A simple activation of the locking member 13 automatically causes the spring member 20 to close the jaw 10 until it engages the object. Thus, by the present invention, a wrench is disclosed which is disposed quickly and easily about a workpiece without the problems associated with the prior art.

Although this invention has been disclosed and described with reference to a particular embodiment, the principles involved are susceptible to other applications which will be apparent to persons skilled in the art. For example, other engaging means can be used to retain the leg 10*b* in the locking member 13, and other automatic return mechanism besides spring 20 can be used to urge leg member 10*b* into the closed position. For example, caming arrangements wherein the cam binds leg 10*b* in one position, as well as interlocking pins, slotted members, and the like can also be used as the engaging means. Alternate configurations for the automatic return mechanisms include, among others, compression springs, piston rods, ect., which exert a selective downward force on the leg 10*b*. Moreover, other configurations of the wrench can also be used. For example, a crescent-type wrench, having a generally circular head section, can be modified by incorporating locking member 13 and return spring 20. This invention, therefore, is not intended to be limited to any particular embodiment herein disclosed.

I claim:

1. An automatic adjusting pipe wrench comprising:

a. a wrench handle having a first fixed jaw;

b. a second slidable jaw having an elongated, wedge shaped leg member, said leg member being coupled to said wrench handle and having a first engaging surface disposed on one side of said leg member;

c. locking member disposed in a slot on said wrench handle, said locking member having a second engaging surface for selectively engaging said first engaging surface on said leg member and retaining said leg member in a predetermined position, said leg member passing through a wedge shaped opening in said locking member; and d. a return spring coupled to said wrench handle and to said second jaw member such that said second jaw member is encouraged into a closed position when said locking member is disengaged from said leg member.

2. The automatic adjusting pipe wrench of claim 1 wherein said wrench handle is comprised of a first outwardly extending section and a second elongated section, said locking member and said leg member being disposed in said first section.

3. The automatic adjusting pipe wrench of claim 1 wherein said locking member is comprised of a block member having a sliding pad adjacent the bottom thereof, said block and pad disposed in said slot such that said pad renders said block member easily slidable.

4. The automatic adjusting pipe wrench of claim 3 wherein a wedge shaped hole is disposed through said block and said pad, and said leg member passes through said wedge shaped hole.

5. The automatic adjusting pipe wrench of claim 3 wherein said block member and said pad member form a locking member having a generally rectangular shape.

6. An automatic adjusting pipe wrench comprising:

a. a wrench handle having an elongated section with a first fixed jaw member adjacent the top thereof;

b. a second slidable jaw member coupled to said handle, said second jaw member having an elongated, wedge shape leg member and first engaging tooth members disposed adjacent the bottom of said leg member;

c. a locking member slidably disposed in said wrench, said locking member comprising a block and pad combination, said block and pad having a wedge shaped hole with said leg member passing therethrough, said block having second engaging tooth members for selectively engaging said first tooth members on said leg member and retaining said leg member in a predetermined position; and d. a return spring coupled to said wrench handle and to said second jaw member such that said second jaw member is encouraged into a closed position when said locking member is disengaged from said leg member.

7. The automatic adjusting pipe wrench of claim 6 wherein said locking member is disposed in a slot in said wrench, said slot located on said wrench such that the back end of said locking member is outwardly exposed.

8. The automatic adjusting pipe wrench of claim 6 wherein said pad is made of rubber.

9. The automatic adjusting pipe wrench of claim 6 wherein said wedge shaped hole is comprised of first and second connected openings with said second tooth members located in said second opening, when said leg member in in said first opening, said leg member is disengaged from said second tooth members and is rendered slidable therein, and when said leg member is in said second opening, and first tooth members on said leg member engages said second tooth members in said second opening and holds said leg member in position.

* * * * *